US007485590B2

(12) United States Patent
Rabasco et al.

(10) Patent No.: US 7,485,590 B2
(45) Date of Patent: Feb. 3, 2009

(54) SELF-CROSSLINKING VINYL ACETATE-ETHYLENE POLYMERIC BINDERS FOR NONWOVEN WEBS

(75) Inventors: John Joseph Rabasco, Allentown, PA (US); John Richard Boylan, Bethlehem, PA (US); Dennis Sagl, Fogelsville, PA (US); Ronald Bernal Jones, Allentown, PA (US)

(73) Assignee: Wacker Chemical Corporation

( * ) Notice: Subject to any disclaimer, the term of this patent is extended or adjusted under 35 U.S.C. 154(b) by 0 days.

(21) Appl. No.: 11/540,299

(22) Filed: Sep. 29, 2006

(65) Prior Publication Data

US 2008/0081530 A1 Apr. 3, 2008

(51) Int. Cl.
*B32B 9/04* (2006.01)
*B32B 27/12* (2006.01)

(52) U.S. Cl. ..... 442/155; 442/149

(58) Field of Classification Search ..... 442/155, 442/149

See application file for complete search history.

(56) References Cited

U.S. PATENT DOCUMENTS

| | | | |
|---|---|---|---|
| 3,081,197 | A | 3/1963 | Adelman |
| 3,137,589 | A | 6/1964 | Reinhard et al. |
| 3,380,851 | A | 4/1968 | Lindemann et al. |
| 4,449,978 | A | 5/1984 | Iacoviello |
| 5,540,987 | A | 7/1996 | Mudge et al. |
| 6,562,892 | B2 | 5/2003 | Eknoian et al. |
| 2003/0073777 | A1 | 4/2003 | Elknoian et al. |
| 2003/0232559 | A1 | 12/2003 | Goldstein et al. |

*Primary Examiner*—Lynda Salvatore

(57) ABSTRACT

This invention is directed to an improvement in nonwoven products comprised of a nonwoven web of fibers bonded together with polymeric binder comprised of emulsion polymerized units of vinyl acetate, ethylene, and a crosslinking monomer. The polymer is stabilized with a surfactant having a critical micelle concentration of about 0.5 to 3% by weight. The surfactant is employed in the polymerization in an amount less than 1% by weight, based upon the total weight of polymer.

9 Claims, No Drawings

SELF-CROSSLINKING VINYL ACETATE-ETHYLENE POLYMERIC BINDERS FOR NONWOVEN WEBS

BACKGROUND OF THE INVENTION

Nonwoven webs find application in a number of end uses, including paper towels, disposable diapers, filtration products, disposable wipes, and the like. Nonwoven products or fabrics comprise loosely assembled webs or masses of fibers bound together with an adhesive, polymer or polymeric binder. Fibers often are comprised of cellulosic or polymeric materials such as polyesters, polyamides, polyacrylates, and the like. The base web of nonwoven fibers, to which the polymeric binder is applied, can be produced by carding, garnetting, airlaying, papermaking procedures, or other known operations. Bonding fibers in place with a polymeric binder is much less expensive than the use of conventional spinning and weaving to form woven fabrics and the bonded nonwoven fabrics can be made in a much greater range of thicknesses per unit weight, with more homogeneous structures, no unraveling tendency, and with greater water absorbency, porosity, and resiliency.

Two major factors that lead to acceptable nonwoven products are the wet tensile strength and "feel" of the nonwoven product. Personal care products such as tissues, handwipes and sanitary napkins must have sufficient wet tensile strength to remain intact when wet and sufficient softness or feel when in contact with the skin. However, to achieve desirable or sufficient wet tensile strength it has been common practice to elevate the dry tensile strength of the polymer or use higher add-on levels of polymeric binder. Higher dry tensile strengths in a nonwoven product tend to impart stiffness or hardness to the product and make the nonwoven product uncomfortable to the touch. Higher add-on levels of polymeric binder are therefore undesirable because of the "feel" of the product and the cost of using larger amounts of polymeric binder.

There has been an industry move to improve the wet tensile strength of a nonwoven product in relation to its dry tensile strength with the dry tensile strength of a nonwoven product generally being secondary to its wet tensile strength. A product that has a high wet/dry tensile strength ratio is desired because it generally permits a lower add-on level of polymer to the nonwoven product, thereby improving the "feel" of the product and reducing manufacturing costs without sacrificing wet strength.

Polymeric binders based upon a vinyl acetate and ethylene backbone incorporating a self crosslinking monomer have been widely used in the nonwoven industry. Ethylene in the polymer provides softness to the product and is low cost. But, softness in the product often comes at the expense of wet tensile strength. Increasing the level of self crosslinkable monomer in the polymer often is not a viable option to increased wet strength. Against that background, the nonwoven industry is desirous of self-crosslinking vinyl acetate-ethylene based polymers having increased wet/dry tensile strength ratios at conventional add-on levels.

Representative of various vinyl acetate based binder compositions used for producing nonwoven products include:

U.S. Pat. No. 3,081,197 (Adelman, 1963) discloses a nonwoven binder comprising polymers of vinyl acetate, a polymerizable compound suited as an internal plasticizer, e.g., butyl acrylate and dibutyl maleate, and a post-curable comonomer such as N-methylol acrylamide. The binders can be prepared by interpolymerization of the monomers in aqueous dispersion systems containing nonionic, anionic or cationic dispersing agents.

U.S. Pat. No. 6,562,892 (Eknoian et al., 2003) discloses ethylene-vinyl acetate emulsion polymers having greater than 55 percent by weight ethylene which is water dispersible but non-dispersible in an aqueous solution containing 0.5 percent or more of an inorganic salt and is stabilized with a hydrophilic polymeric colloid. The hydrophilic polymeric colloid contains at least one hydrophilic monomer. The hydrophilic monomer may be an acidic monomer containing a carboxylic acid, e.g., a carboxylic acid or dicarboxylic acid, a sulfonic acid, or phosphonic group.

U.S. Pat. No. 3,137,589 (Mannheim et al., 1964) discloses binders comprising a copolymer of an alpha, beta-unsaturated carboxylic acid amide substituted on the nitrogen by at least one methylol group and another unsaturated polymerizable compound.

U.S. Pat. No. 3,380,851 (Lindemann et al., 1968) discloses a binder comprising an interpolymer of vinyl acetate-ethylene-N-methylol acrylamide. The ethylene content is from 5 to 40% by weight.

U.S. Pat. No. 4,449,978 (Iacoviello, 1984) discloses a nonwoven product formed from a nonwoven web of fibers bonded together with a binder comprising an interpolymer of vinyl acetate, ethylene, N-methylol acrylamide, and acrylamide monomers. The nonwoven products are reported to have low residual free formaldehyde content and good tensile properties.

U.S. Pat. No. 5,540,987 (Mudge et al., 1996) discloses the formation of formaldehyde free and formaldehyde reduced vinyl acetate-ethylene binders for nonwoven products. These binders are formed by emulsion polymerization using an initiator system based upon an organic peroxide and ascorbic acid. The crosslinking agent can be N-methylolacryl amide for nonwovens of reduced formaldehyde and N-iso-butoxy methyl acrylamide for formaldehyde free nonwovens.

US 2003/0232559 A1 (Goldstein et al., 2003) discloses adhesive polymeric binders comprised of a polymer containing polymerized units of vinyl acetate, ethylene, vinyl chloride, and a self-crosslinking monomer.

BRIEF SUMMARY OF THE INVENTION

This invention is directed to an improved nonwoven product comprised of a nonwoven web of fibers bonded with a polymeric binder comprised of vinyl acetate, ethylene, and a crosslinking monomer formed by an emulsion polymerization process. The improvement in the nonwoven product leading to improved wet tensile strength comprises:

employing a surfactant having a critical micelle concentration (CMC) of from about 0.5 to 3% by weight, preferably from about 1 to 2% by weight, as a stabilizer in said emulsion polymerization process. In a preferred embodiment the surfactant is employed in said emulsion polymerization process in an amount generally less than 1% by weight, based on the total weight of the polymer.

Significant advantages can be achieved with these nonwoven products incorporating low surfactant, vinyl acetate/ethylene based emulsion polymers and these include:

an ability to improve upon existing emulsion polymerized crosslinkable vinyl acetate-ethylene emulsion polymer technology for nonwoven products wherein high wet tensile strength with excellent rates of absorption in cellulosic containing webs are imparted at reasonable coat weights; and, an ability to improve upon existing emulsion polymerized crosslinkable vinyl acetate-ethylene emulsion polymer technology by providing self-crosslinking vinyl acetate-ethylene-vinyl chloride binders for paper applications

DETAILED DESCRIPTION OF THE INVENTION

This invention is directed to an improvement in a nonwoven product comprising a nonwoven web of fibers bonded together with a sufficient amount of a polymeric binder which has been formed by emulsion polymerization to form a self-sustaining web. The polymeric binder is comprised of polymerized units of vinyl acetate, ethylene, and a crosslinking monomer. The improvement in the nonwoven product resides in a polymeric binder wherein the stabilizer employed in the emulsion polymerization of the polymer is a surfactant which has a CMC of from 0.5 to 3% by weight, and preferably from about 1 to 2% by weight. CMC is the concentration of a surfactant in solution above which the formation of micelles occur.

In preferred embodiments, the surfactant in the emulsion polymerization is employed in an amount generally less than 1% by weight, preferably less than 0.8% by weight, based on the total weight of polymer. Higher levels of surfactant may be used, e.g., up to 2 to 2.5% by weight, based on the total weight of the polymer, but the higher levels contribute to higher cost while affording no significant advantages.

The vinyl acetate based emulsion polymer is comprised generally of polymerized units of ethylene ranging from 3% to 30% by weight, polymerized units of 1% to 10% by weight crosslinking monomer, preferably from 3% to 6% by weight, and the remainder of the polymer being vinyl acetate. Typically, the level of ethylene in the polymer is that which affords a glass transition temperature in the polymer of from about 5 to 20° C.

Crosslinking monomers suited for forming the polymer or polymeric binder include N-methylolacrylamide (NMA), a mixture of NMA and acrylamide, typically in a 50/50 molar ratio, often referred to as MAMD; acrylamidobutyraldehyde, dimethylacetal diethyl acetal, acrylamidoglycolic acid, methylacrylamidoglycolate methyl ether, isobutylmethylol acrylamide and the like. NMA and MAMD are the crosslinkers of commercial choice.

Other comonomers can be employed in the emulsion polymerization of polymers for nonwoven goods described herein. If a comonomer is used, the level can be about 0.5 to 10% by weight, based on the total weight of the polymer. The amount of comonomer can also be 3 to 8% by weight, based on the total weight of the polymer. Examples of comonomers include vinyl chloride, $C_{1-8}$ (meth)acrylates, such as butyl and 2-ethylhexyl acrylate, vinyl $C_{8-12}$ aliphatic esters such as vinyl versatate; and carboxylic acids such as (meth)acrylic acid. Vinyl chloride is a preferred comonomer, if one or more monomers are employed, as it affords higher wet tensile strength in the nonwoven product and it also affords some resistance to flammability.

One of the keys to increasing the wet tensile strength of the nonwoven goods resides in the stabilization system employed in the formation of the emulsion polymerized polymeric binder. Whereas in the traditional manner of forming emulsion polymerized vinyl acetate based polymers, a variety of surfactants have been used, e.g., nonionic, anionic and cationic, it has also been traditional to employ these surfactants at significant levels, e.g., 2 to 3% by weight, based upon the total weight of the polymer. It has been found that significant benefits in the resulting nonwoven product can be achieved if one in effecting emulsion polymerization of the vinyl acetate based polymer uses a surfactant having a CMC of from 0.5 to 3% by weight and, preferably from about 1 to 2% by weight of the surfactant. It is also preferred that one employ less than about 1% by weight of the surfactant. The amount of surfactant can also be less 0.8% by weight, or 0.4 to 0.8% by weight, based upon the total weight of polymer in the emulsion polymerization process. The minimum amount of stabilizer employed in the emulsion polymerization should be an amount that is sufficient to form a stable emulsion. The use of a surfactant having the described CMC allows for a lower level of surfactant in emulsion polymerization without sacrificing stability and it allows for the production of a polymer capable of imparting higher wet strength to the nonwoven product.

Examples of surfactants having CMC of from 0.5 to 3% by weight, include the dihexyl ester of sodium sulfosuccinate, sodium 2-ethylhexyl sulfate, sodium isobutyl sulfosuccinate, sodium diamyl sulfosuccinate, sodium dicyclohexyl sulfosuccinate, and sodium diisopropylnaphthalene sulfosuccinate. The dihexyl ester of sodium sulfosuccinate is a preferred surfactant.

It is also preferred to incorporate a copolymerizable stabilizing monomer into the polymer, in addition to using a surfactant previously described, in the polymerization process. Examples of stabilizing monomers include functional monomers, such as 2-acrylamido-2-methylpropanesulfonic acid (AMPS) or sodium vinyl sulfonate (SVS). The copolymerizable stabilizing monomer can be used at levels ranging from 0.5 to 5 wt %, preferably 0.5 to 2 wt % based upon the weight of the polymer.

In the formation of nonwoven products, the starting layer or mass can be formed by any one of the conventional techniques for depositing or arranging fibers in a web or layer. These techniques include carding, garnetting, air-laying, and the like. Individual webs or thin layers formed by one or more of these techniques can also be laminated to provide a thicker layer for conversion into a fabric. Typically, the fibers extend in a plurality of diverse directions in general alignment with the major plane of the fabric, overlapping, intersecting, and supporting one another to form an open, porous structure. When reference is made to "cellulose" fibers, those fibers containing predominantly $C_6H_{10}O_5$ groupings are meant. Thus, examples of the fibers to be used in the starting layer are natural cellulose fibers such as wood pulp, cotton, and hemp and the synthetic cellulose fibers such as rayon, and regenerated cellulose. Often the fibrous starting layer contains at least 50% cellulose fibers, whether they are natural or synthetic, or a combination thereof. Often the fibers in the starting layer may comprise natural fibers such as wool, or jute; artificial fibers such as cellulose acetate; synthetic fibers such as polyamides, nylon, polyesters, acrylics, polyolefins, i.e., polyethylene, polyvinyl chloride, polyurethane, and the like, alone or in combination with one another. The fibrous starting layer is subjected to at least one of the several types of bonding operations to anchor the individual fibers together to form a self-sustaining web. Some of the better known methods of bonding are overall impregnation, or printing the web with intermittent or continuous straight or wavy lines or areas of binder extending generally transversely or diagonally across the web and additionally, if desired, along the web.

The amount of polymeric binder, calculated on a dry basis, applied to the fibrous starting web is generally about 3% or more by weight, and can range from about 10% to about 100% or more by weight of the starting web, preferably from about 10 to about 30% by weight of the starting web depending upon the properties desired. The impregnated web is then dried and cured. Thus, the coated webs are suitably dried by passing them through an air oven or the like and then through a curing oven. Typical conditions to achieve optimal crosslinking are sufficient time and temperature such as drying at 65° C. to 90° C. for 4 to 6 minutes, followed by curing at 150° C. to 155° C. for 3 to 5 minutes or more. However, other time-temperature relationships can be employed as is well known in the art, shorter times at higher temperatures or longer times at lower temperatures being used.

The following examples are provided to illustrate various embodiments of the invention and are not intended to limit the scope thereof.

EXAMPLE 1

Nonwoven Binder of Vinyl Acetate, Ethylene, and NMA Using Dihexyl Ester of Sodium Sulfosuccinate Surfactant A one-gallon stainless steel pressure reactor was charged with the following mixture:

| Material | Mass charged, g |
|---|---|
| DI Water | 900 |
| Aerosol ® MA-80-I surfactant | 8.8 |
| Sodium Acetate | 0.5 |
| Ferrous Ammonium Sulfate (1%) | 2.0 |
| Vinyl Acetate | 262.5 |
| Ethylene | 225 |

Aerosol MA-80-I surfactant, supplied by Cytec Industries Inc., is the dihexyl ester of sodium sulfosuccinic acid and has a CMC of from 1.2 to 1.6% by weight of the surfactant.

Prior to the addition of ferrous ammonium sulfate and vinyl acetate, the pH was adjusted to 4.5 by the addition of acetic acid.

The following delay mixtures were utilized:

| Material | Mass charged, g |
|---|---|
| Aqueous 3.75 wt % sodium persulfate containing 1.33 wt % sodium bicarbonate | 121.99 |
| Aqueous 2.25 wt % sodium erythorbate | 122.19 |
| Vinyl Acetate | 1440 |
| Aqueous solution containing 200 g NMA (48%), 100 g Lubrizol ® 2403 (50%), and 84 g DI Water | 348 |

NMA refers to N-methylolacrylamide
Lubrizol 2403, supplied by Lubrizol, is 2-acrylamido-2-methylpropane sulfonic acid, and is commonly referred to as AMPS.

Agitation at 300 rpm was begun with a nitrogen blanket. Agitation was then increased to 900 rpm and the reactor heated to 55° C. After pressurizing the reactor with 225 grams of ethylene (675 psig; 4755 kPa) followed by an equilibration period, the polymerization was initiated by the addition of sodium persulfate solution at 0.40 g/min and sodium erythorbate solution at 0.40 g/min. At initiation, the vinyl acetate delay was begun at 8.8 g/min, the NMA delay was begun at 2.16 g/min, and the reactor temperature was ramped to 85° C. over the next 30 minutes. The sodium persulfate and sodium erythorbate redox rates were adjusted in order to maintain appreciable polymerization rates. After the vinyl acetate, and NMA delays were completed, the redox rates were increased in steps to drive the unreacted vinyl acetate levels below 2 wt %. Five minutes after the vinyl acetate delay was completed, the reactor temperature was ramped down to 55° C. over a 25 minute period. The reactor contents were then transferred to a degassing vessel, and 1 g of Colloid 675 defoamer was added. The following properties of the resulting emulsion polymer were measured:

| | |
|---|---|
| Solids (wt %) | 57.1 |
| $T_g$ Onset (° C.) | 16.57 |
| Viscosity (60/12 rpm) (cps) | 558/790 |
| 100/325 mesh coagulum (ppm) | 66/33 |
| Accelerated Sedimentation (%) | 0.5 |
| pH | 4.7 |

The percent of the respective components based upon the total weight of polymer was calculated as 82.7% vinyl acetate, 10.9% ethylene, 4.2% NMA, 2.2% AMPS and 0.4% surfactant.

EXAMPLE 2

Nonwoven Binder of Vinyl Acetate, Ethylene, and NMA in Dioctyl Ester of Sodium Sulfosuccinate The procedure of Example 1 was repeated except, for comparative purposes, Aerosol® A-102 surfactant and Rhodacal® DS10 surfactant were substituted for Aerosol MA-80-I surfactant in the production of the polymeric binder. Aerosol A-102 surfactant and Rhodacal DS10 surfactant are commonly used in preparing vinyl acetate based polymers suited for nonwoven products and have a CMC of from about 0.08 to 0.12% by weight.

A one-gallon stainless steel pressure reactor was charged with the following mixture:

| Material | Mass charged, g |
|---|---|
| DI Water | 900 |
| Aerosol A-102 surfactant | 13.5 |
| Rhodacal DS10 surfactant | 2.7 |
| Sodium Acetate | 0.5 |
| Ferrous Ammonium Sulfate (1%) | 2.0 |
| Vinyl Acetate | 262.5 |
| Ethylene | 225 |

Aerosol A-102 surfactant, supplied by Cytec, is disodium ethoxylated alcohol [$C_{10-12}$] half ester of sulfosuccinic acid.
Rhodacal DS10, supplied by Rhodia, is sodium dodecyl benzene sulfonate and has a CMC of about 0.08 to 0.1% by weight.

Prior to the addition of ferrous ammonium sulfate and vinyl acetate the pH was adjusted to 4.5 by the addition of acetic acid.

The following delay mixtures were utilized:

| Material | Mass charged, g |
|---|---|
| Aqueous 3.75 wt % sodium persulfate containing 4.0 wt % sodium bicarbonate | 300.0 |
| Aqueous 2.25 wt % sodium erythorbate | 300.0 |
| Vinyl Acetate Monomer | 1600.0 |
| Aqueous solution containing 200 g NMA (48%), 100 g Lubrizol 2403 (50%), 83 g DI Water, and 1.0 g methoxy phenol | 295 |

Agitation at 300 rpm was begun with a nitrogen purge. Agitation was then increased to 900 rpm and the reactor heated to 55° C. After pressurizing the reactor with 225 grams of ethylene (741 psig; 5211 kPa) followed by an equilibration period, the polymerization was initiated by the addition of sodium persulfate solution at 0.40 g/min and sodium erythorbate solution at 0.40 g/min. At initiation, the vinyl acetate delay was begun at 10.6 g/min, the NMA delay was begun at 2.49 g/min, and the reactor temperature was ramped to 85° C. over the next 30 minutes. The sodium persulfate and sodium erythorbate redox rates were adjusted in order to maintain appreciable polymerization rates. After the vinyl acetate and NMA delays were completed, the redox rates were increased in steps to drive the unreacted vinyl acetate levels below 2 wt %. Five minutes after the AMPS/NMA delay was completed, the reactor temperature was ramped down to 50° C. over a 25 minute period. The reactor contents were then transferred to a degassing vessel, and 1 g of Rhodoline 675 defoamer was added. The following properties of the resulting emulsion polymer were measured:

| | |
|---|---|
| Solids (wt %) | 54.7 |
| $T_g$ Onset (° C.) | 15.61 |
| Viscosity (60/12 rpm) (cps) | 246/398 |
| 100/325 mesh coagulum (ppm) | 67/35 |
| Accelerated Sedimentation (%) | 1.0 |
| pH | 4.9 |

The percent of the respective components based upon the total weight of polymer was calculated as 82.2% vinyl acetate, 11.8% ethylene, 4.0% NMA, 2.0% AMPS and 0.9% surfactant.

EXAMPLE 3

Nonwoven Binder of Vinyl Acetate, Ethylene, Vinyl Chloride, and NMA Using Dihexyl Ester of Sodium Sulfosuccinate Surfactant The procedure of Example 1 was repeated except that vinyl chloride was included in the emulsion polymerization. The purpose here was to determine if the inclusion of vinyl chloride in the polymer might be effective in improving the wet/dry strength ratio when employed in a nonwoven product.

A one-gallon stainless steel pressure reactor was charged with the following mixture:

| Material | Mass charged, g |
|---|---|
| DI Water | 1000 |
| Aerosol MA-80-I | 12 |
| Sodium Acetate | 0.5 |
| Ferrous Ammonium Sulfate (1%) | 2.0 |
| Vinyl Acetate | 262 |
| Vinyl Chloride | 25 |
| Ethylene | 225 |

Prior to the addition of ferrous ammonium sulfate, vinyl acetate, and vinyl chloride, the pH was adjusted to 4.5 by the addition of acetic acid.

The following delay mixtures were utilized:

| Material | Mass charged, g |
|---|---|
| Aqueous 3.75 wt % sodium persulfate containing 1.33 wt % sodium bicarbonate | 191 |
| Aqueous 2.25 wt % sodium erythorbate | 191 |
| Vinyl Acetate | 1295 |
| Vinyl Chloride | 144 |
| Aqueous solution containing 270 g NMA (48%), 60 g Lubrizol 2403 (50%), 53 g DI Water, and 1 g p-methoxyphenol (1%) | 295 |

Agitation at 300 rpm was begun with a nitrogen purge. Agitation was then increased to 900 rpm and the reactor heated to 55° C. After pressurizing the reactor with 225 grams of ethylene (691 psig; 4866 kPa) followed by an equilibration period, the polymerization was initiated by the addition of sodium persulfate solution at 0.40 g/min and sodium erythorbate solution at 0.40 g/min. At initiation, the vinyl acetate delay was begun at 10.8 g/min, the NMA delay was begun at 2.46 g/min, the vinyl chloride delay was begun at 1.2 g/min, and the reactor temperature was ramped to 85° C. over the next 30 minutes. The sodium persulfate and sodium erythorbate redox rates were adjusted in order to maintain appreciable polymerization rates. After the vinyl acetate, NMA, and vinyl chloride delays were completed, the redox rates were increased in steps to drive the unreacted vinyl acetate levels below 2% by weight. 20 minutes after the vinyl acetate delay was completed, the reactor temperature was ramped down to 55° C. over a 25-minute period. The reactor contents were then transferred to a degassing vessel, and 1 g of Rhodoline 675 defoamer was added. The following properties of the resulting emulsion polymer were measured:

| | |
|---|---|
| Solids (wt %) | 54.8 |
| $T_g$ Onset (° C.) | 18.6 |
| Viscosity (60/12 rpm) (cps) | 296/480 |
| 100/325 mesh coagulum (ppm) | 22/46 |
| Accelerated Sedimentation (%) | 1.0 |
| pH | 4.2 |

The percent of the respective components based upon the total weight of polymer was calculated as 75.1% vinyl acetate, 10.8% ethylene, 8.1% vinyl chloride, 4.8% NMA, 1.1% AMPS, and 0.6% surfactant.

EXAMPLE 4

Nonwoven binder of Vinyl Acetate, Ethylene, Vinyl Chloride, and NMA Using Dihexyl Ester of Sodium Sulfosuccinate Surfactant The procedure of Example 3 was repeated except that all the VCI was delayed into the reaction. None of the VCI was batched, while a portion of the VCI was batched in Example 1.

A one-gallon stainless steel pressure reactor was charged with the following mixture:

| Material | Mass charged, g |
|---|---|
| DI Water | 1000 |
| Aerosol MA-80-I | 12 |
| Sodium Acetate | 0.5 |
| Ferrous Ammonium Sulfate (1%) | 2.0 |
| Vinyl Acetate | 262 |
| Ethylene | 250 |

Prior to the addition of ferrous ammonium sulfate and vinyl acetate the pH was adjusted to 4.5 by the addition of acetic acid.

The following delay mixtures were utilized:

| Material | Mass charged, g |
|---|---|
| Aqueous 3.75 wt % sodium persulfate containing 1.33 wt % sodium bicarbonate | 177 |
| Aqueous 2.25 wt % sodium erythorbate | 179 |
| Vinyl Acetate | 1295 |
| Vinyl Chloride | 144 |
| Aqueous solution containing 230 g NMA (48%), 60 g Lubrizol 2403 (50%), 94 g DI Water | 295 |

Agitation at 300 rpm was begun with a nitrogen purge. Agitation was then increased to 900 rpm and the reactor heated to 55° C. After pressurizing the reactor with 250 grams of ethylene (749 psig; 5266 kPa) followed by an equilibration period, the polymerization was initiated by the addition of sodium persulfate solution at 0.40 g/min and sodium erythorbate solution at 0.40 g/min. At initiation, the vinyl acetate delay was begun at 10.8 g/min, the NMA delay was begun at 2.46 g/min, the vinyl chloride delay was begun at 1.2 g/min, and the reactor temperature was ramped to 85° C. over the next 30 minutes. The sodium persulfate and sodium erythorbate redox rates were adjusted in order to maintain appreciable polymerization rates. After the vinyl acetate, NMA, and vinyl chloride delays were completed, the redox rates were increased in steps to drive the unreacted vinyl acetate levels below 2 wt %. Twenty five minutes after the vinyl acetate delay was completed, the reactor temperature was ramped down to 50° C. over a 25 minute period. The reactor contents were then transferred to a degassing vessel, and 1 g of Rhodoline 675 defoamer was added. The following properties of the resulting emulsion polymer were measured:

| | |
|---|---|
| Solids (wt %) | 55.8 |
| $T_g$ Onset (° C.) | 15.1 |
| Viscosity (60/12 rpm) (cps) | 294/455 |
| 100/325 mesh coagulum (ppm) | 38/10 |
| Accelerated Sedimentation (%) | 3.0 |
| pH | 4.4 |

The percent of the respective components based upon the total weight of polymer was calculated as 75.6% vinyl acetate, 12.1% ethylene, 7.0% vinyl chloride, 4.1% NMA, 1.1% AMPS, and 0.6% surfactant.

EXAMPLE 5

Evaluation of Polymeric Binders in Nonwoven Web

The binders of Examples 1 to 4 were evaluated for tensile performance on nonwoven cellulosic substrates and compared to a commercial vinyl acetate based polymer, i.e., AIRFLEX® 192 polymer emulsion, which is commercially used for producing nonwoven products. AIRFLEX 192 is a self-crosslinking vinyl acetate-ethylene (VAE) polymer emulsion of similar VAE/NMA composition to the polymer of Example 1 in that it has a Tg of from about 10 to 12° C. The stabilizer employed in the AIRFLEX 192 polymer emulsion is comprised of a surfactant employed in an amount of from about 2 to 2.5% based upon the weight of the polymer and having a CMC of about 0.08 to 0.12% by weight.

The process of forming the high performance nonwoven webs comprises applying an aqueous polymeric emulsion to a cellulosic based nonwoven web by either spray application or print application methods, removing excess water; and crosslinking the crosslinkable polymer with an effective amount ammonium chloride catalyst and heating to ensure complete reaction. The bonded substrate is subsequently conditioned, cut into uniform strips and tested on a mechanical tensile tester such as an Instron for both dry and wet tensile properties.

The following procedure was used in the evaluation of the materials described herein. The binder formulation consisted of an emulsion polymer composition described herein, water, 1% (solids on solids) ammonium chloride ($NH_4Cl$) as a catalyst for the self crosslinking reaction, and a small amount of a wetting surfactant. The binder composition was diluted to 10% solids and uniformly sprayed onto an airlaid web of an 85:15 blend of cellulose and low melt bicomponent fibers (basis weight 75 g/m$^2$ as supplied). The targeted add-on weight of binder was 20 wt %+/−2 wt %. The sprayed webs were dried and cured in a Mathis LTE through air oven at 160° C. for 3 minutes.

Test methods similar to industry standards, such as ASTM-D1117 (Mechanical Tensile Testing of Strength of Paper and Paperboard), TAPPI T-494 (dry tensile) and TAPPI T-456 (Wet Tensile Strength Determination Using Finch Cup Apparatus) were used to measure tensile strength.

The specific procedure for measuring wet tensile strength was as follows: The finished (bonded) dried and cured airlaid web was cut into 5 cm wide strips in the substrate's cross machine direction. The strips were looped around the finch cup apparatus that was then filled with the wet tensile fluid (either deionized water or deionized water with a small amount of a wetting agent was added, such as 0.5% (solids on solids) Aerosol-OT, a commercially available dioctyl sodium sulfosuccinate surfactant. TAPPI T-456 procedure was then followed. An Instron Model 1122 mechanical tensile tester was used to measure dry and wet tensile strength. The tensile strength is reported in grams per 5 cm (g/5 cm).

The data are set forth in Table 1. In the table, values for both wet and dry tensile strength are an average. The wet strength is characterized as a percentage of the control (value wet % of specific Example divided by the value wet strength of AIRFLEX 192 VAE). Absolute values for the examples and AIRFLEX 192 VAE control are not representative because of the time differences between testing. One must use the wet %/AIRFLEX 192 VAE value for purposes of making comparisons between the runs.

TABLE 1

| Sample | Dry Tensile g/5 cm | Wet Tensile g/5 cm | Wet Tensile % of AIRFLEX 192 VAE | Wet Tensile to Dry Tensile Ratio |
|---|---|---|---|---|
| Example 1 | 2976 | 1702 | 118.9 | 0.57 |
| AIRFLEX 192 VAE | 2887 | 1431 | 100.0 | 0.50 |
| Example 2 | 2657 | 1569 | 101.4 | 0.59 |
| AIRFLEX 192 VAE | 2751 | 1547 | 100.0 | 0.56 |
| Example 3 | 3101 | 2068 | 130.6 | 0.67 |
| AIRFLEX 192 VAE | 2884 | 1583 | 100.0 | 0.55 |
| Example 4 | 3502 | 2295 | 129.3 | 0.66 |
| AIRFLEX 192 VAE | 3227 | 1774 | 100 | 0.55 |

The polymer of Example 1 compared to AIRFLEX 192 VAE shows that the wet tensile strength can be increased by about 18% when the polymerization is carried out in the presence of the high critical micelle concentration surfactant compared to AIRFLEX 192 VAE where the surfactant has a low critical micelle concentration. The wet tensile strength can be increased by about 30% (Examples 3 and 4) when vinyl chloride is incorporated in the polymer.

On the other hand the polymer of Example 2 shows that the wet tensile strength of the nonwoven product is not improved compared to the control AIRFLEX 192 VAE, by the selection of a emulsifier having a critical micelle concentration in the range of 0.08 to 0.1% by weight. The Example 2 polymer produced using Aerosol A-102 in the emulsion polymerization, even though using a stabilizing comonomer, resulted in a nonwoven product substantially equivalent to the AIRFLEX 192 VAE control. Also, the fact that a lower level of surfactant was used in the emulsion polymerization than used in the AIRFLEX 192 VAE control shows that such surfactant reduction did not significantly improve the wet tensile strength.

As stated, the results of Examples 3 and 4 wherein the polymers incorporate a small amount of vinyl chloride, showed significant improvement in wet tensile strength as compared to the control AIRFLEX 192 VAE. Thus, the combination of the low level of surfactant, the type of surfactant, and the vinyl chloride in the polymer, led to improved nonwoven products.

The polymers of Examples 1, 3 and 4 also showed excellent rates of absorption and comparable to the control AIRFLEX 192 VAE polymeric binder.

What is claimed is:

1. In a nonwoven product comprised of a nonwoven web of fibers bonded together with a sufficient amount of polymeric binder to form a self-sustaining web, said polymeric binder comprised of a polymer containing vinyl acetate, ethylene, and a crosslinking monomer, said polymeric binder formed by emulsion polymerization, the improvement which comprises:

employing a surfactant having a critical micelle concentration of from 0.5 to 3% by weight of said surfactant in said emulsion polymerization and wherein the surfactant is employed in the emulsion polymerization in an amount of less than 1% by weight of the polymeric binder;

said polymer having an ethylene content of from about 3 to 30% by weight, based on the total weight of polymer;

said polymer having a crosslinkable monomer content in an amount of from 1 to 10% by weight, based on the total weight of polymer; and wherein, said polymer contains from 0.5 to 5% of a copolymerizable, stabilizing monomer based upon the total weight of said polymer.

2. The nonwoven product of claim 1 wherein the copolymerizable stabilizing monomer is selected from the group consisting of sodium vinyl sulfonate and 2-acrylamido-2-methylpropane sulfonic acid.

3. The nonwoven product of claim 1 wherein the critical micelle concentration of said surfactant is from about 1 to 2 percent by weight.

4. The nonwoven product of claim 1 wherein the surfactant employed in the emulsion polymerization is selected from the group consisting of the dihexyl ester sodium sulfosuccinate, sodium 2-ethylhexyl sulfate, sodium isobutyl sulfosuccinate, sodium diamyl sulfosuccinate, sodium dicyclohexyl sulfosuccinate, and sodium diisopropylnaphthalene sulfosuccinate.

5. The nonwoven product of claim 1 wherein the Tg of said polymer is from 5 to 20° C.

6. The nonwoven product of claim 1 wherein said polymer contains from 0.5 to 10% by weight vinyl chloride, based on the total weight of the polymer.

7. The nonwoven product of claim 1 wherein said polymer contains from 3 to 8% by weight vinyl chloride, based on the total weight of the polymer.

8. The nonwoven product of claim 1 wherein said polymer contains from 0.5 to 10% by weight of vinyl versatate, based on the total weight of polymer.

9. The nonwoven product of claim 1 wherein the surfactant employed in the emulsion polymerization is the dihexyl ester of sodium sulfosuccinate.

* * * * *